US006144270A

United States Patent [19]

Mader et al.

[11] Patent Number: 6,144,270

[45] Date of Patent: Nov. 7, 2000

[54] ELECTROMAGNETIC RELAY

[75] Inventors: Leopold Mader, Mödling; Rudolf Mikl, Arbesthal, both of Austria

[73] Assignee: Eh-Schrack Components Aktiengesellschaft, Vienna, Austria

[21] Appl. No.: 09/423,280

[22] PCT Filed: Apr. 14, 1998

[86] PCT No.: PCT/EP98/02166

§ 371 Date: Nov. 4, 1999

§ 102(e) Date: Nov. 4, 1999

[87] PCT Pub. No.: WO98/50932

PCT Pub. Date: Nov. 12, 1998

[30] Foreign Application Priority Data

May 5, 1997 [DE] Germany ..... 197 18 986

[51] Int. Cl.[7] ..... H01H 51/22

[52] U.S. Cl. ..... 335/78; 80/128

[58] Field of Search ..... 335/78–85, 128, 335/129, 192, 275, 279

[56] References Cited

U.S. PATENT DOCUMENTS

| | | | |
|---|---|---|---|
| 3,505,629 | 4/1970 | Krautwald et al. | 335/275 |
| 3,553,729 | 1/1971 | Mori et al. | 335/192 |
| 3,701,066 | 10/1972 | Bosch et al. | 335/274 |
| 4,008,447 | 2/1977 | Anderson et al. | 335/128 |
| 4,290,037 | 9/1981 | Inagawa et al. | 335/202 |

FOREIGN PATENT DOCUMENTS

| | | |
|---|---|---|
| 0 784 330 | 7/1997 | European Pat. Off. . |
| 2069216 | 9/1971 | France . |
| 30 08 783 | 10/1981 | Germany . |
| 34 06 832 | 8/1984 | Germany . |
| 34 43 094 | 6/1985 | Germany . |
| 36 44 172 | 7/1988 | Germany . |
| 40 03 558 | 8/1991 | Germany . |
| 301930 | 12/1954 | Switzerland . |
| 2 150 760 | 7/1985 | United Kingdom . |

*Primary Examiner*—Lincoln Donovan
*Assistant Examiner*—Raymond Barrera
*Attorney, Agent, or Firm*—Hill & Simpson

[57] ABSTRACT

The relay has a T-shaped core and a U-shaped armature, the transverse web of the latter being mounted on the free end section of the core longitudinal limb, and the free ends of its longitudinal arms forming two parallel operating air gaps with respect to the transverse limbs of the core. In this way, particularly simple assembly and an operating air gap with large pole areas can be achieved using a small number of simple parts.

10 Claims, 3 Drawing Sheets

ELECTROMAGNETIC RELAY

BACKGROUND OF THE INVENTION

The invention relates to an electromagnetic relay having a coil winding which is arranged on a coil former between coil flanges, a T-shaped core having a longitudinal limb and two transverse limbs, the longitudinal limb extending axially through the coil former, a U-shaped armature having two longitudinal arms, which run on both sides of the coil, and a transverse web, a first end section of the armature being mounted in the region of a first coil flange on an end section of the core, and its second end section forming an operating air gap with the core in the region of the second coil flange, and having a contact arrangement having at least one stationary contact element and at least one moving contact spring, the contact spring being operated by the armature via an operating device which can be moved transversely with respect to the coil axis.

Such a relay has been disclosed, for example, in DE 34 43 094 A1. There, the T-shaped core is expanded into an E-shape or M-shape by projections of the ends of the transverse limbs, which extend parallel to the center limb. The U-shaped armature is mounted at the ends of its longitudinal arms on these projections of the core, so that its transverse web forms the operating air gap with the free end of the center limb of the core. This type of armature mounting on an E-shaped core always involves additional bearing elements in the form of a bearing spring, which not only involves corresponding complexity during production with stamping and bending, but also during assembly with corresponding adjustment and riveting or welding processes. However, such an armature cannot be secured in its mounting in any other way. In addition, there is only a relatively small pole area in the operating air gap between the armature transverse limb the core end, and this pole area cannot readily be enlarged, either.

SUMMARY OF THE INVENTION

The aim of the present invention is to design a relay of the type mentioned initially such that it can be assembled in a particularly simple manner using only a small number of parts which are of simple design and are easy to produce, in which case it is nevertheless possible to achieve reliable operation and a high pull-in reliability by virtue of a relatively large pole area in the operating air gap.

The same is achieved according to the invention in that the armature is mounted via its transverse web on the free end section of the longitudinal limb of the core, and in that the free ends of the armature longitudinal arms form two parallel operating air gaps with the free ends of the core transverse limbs.

Thus, in comparison to the known relay, the armature mounting and the operating air gap are arranged interchanged in the relay according to the invention, so that the U-shaped end of the armature encloses the first coil flange and is thus secured just by virtue of its arrangement in the longitudinal direction of the coil axis. Since the armature can also be secured in other directions in the region of a coil flange by simple structural design, there is no need for any bearing spring, with its corresponding production and assembly effort. On the other hand, the two parallel operating air gaps at the free ends of the armature permit a relatively large pole area. This pole area can additionally be enlarged by the core transverse limbs each being provided at their ends with projections in the direction of the armature longitudinal arms, so that the T-shape of the core is expanded, as indicated, into an M-shape or an E-shape.

In order to secure the armature in its mounting, the first coil flange in a preferred embodiment has an attachment, and this attachment and the armature have projections and/or recesses which engage in one another. The armature can then be further secured in its mounting by a housing cap that is plugged on.

The contact spring that is operated by the armature is preferably arranged approximately parallel to the coil axis on the side of the coil opposite the armature, and the armature movement is transmitted to the contact spring by a slide which is guided between the transverse limbs of the core on the one side and the adjacent coil flange on the other side, such that it moves at right angles to the coil axis. An attachment on the said housing cap can also provide additional guidance for the slide.

The first coil flange can have a projection in the form of a base beyond the attachment for the armature mounting, which base defines a base plane which the coil axis extends at a right angle. The at least one contact spring and the at least one mating contact element are then expediently anchored at right angles to the base and plane in the base, associated connecting pins are passed through the base to the exterior, at right angles. At least one stop is preferably provided on the second coil flange for the contact-making ends of these contact elements, and this stop defines the rest position of the mating contact element and/or of the contact spring.

The moving ends of the armature longitudinal arms are preferably pre-stressed away from the core into a rest position by means of a resetting spring force and, furthermore, a fulcrum is preferably in each case provided in the center region of these longitudinal limbs, and by means of a stop on a housing part, the resetting spring force forces the transverse web of the armature into its bearing on the core. This ensures, even without any bearing spring, that the armature has the smallest possible air gap to the core in its rest position, resulting in good flux transfer and high pull-in sensitivity. Since this resetting spring force is preferably applied by the contact spring, the number of individual parts in the relay can be kept particularly small. The fulcrum in the center region of the armature can be produced by shoulders (which are integrally formed at the sides) on the armature longitudinal arms in conjunction with a corresponding rib or groove on the inside of the housing cap, so that no additional parts or assembly processes are required.

The invention will be explained in more detail in the following text with reference to an exemplary embodiment and using the drawings.

DESCRIPTION OF THE PREFERRED EMBODIMENT

Figure 1:
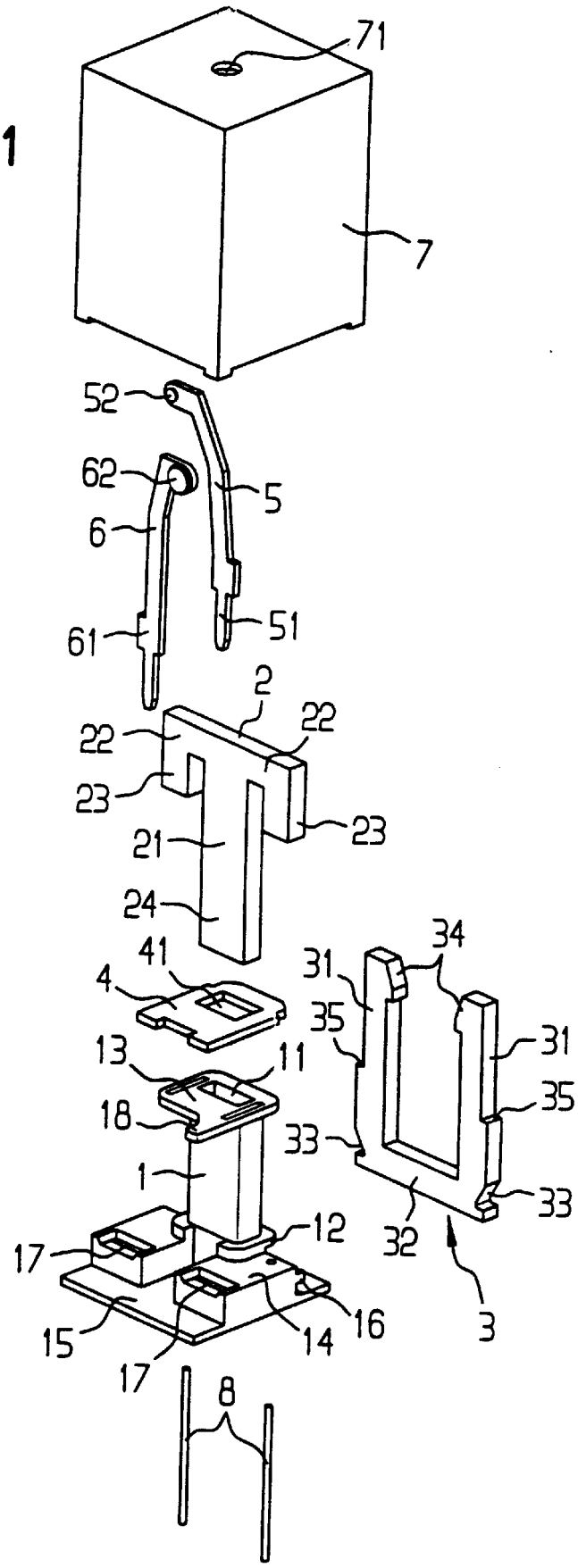
FIG. 1 shows an exploded illustration of a relay designed according to the invention.

The relay illustrated in the drawing comprises a coil former 1, a T-shaped or approximately M-shaped core 2, a U-shaped armature 3, a slide 4 in the form of a card, a stationary contact spring 5, a moving contact spring 6, a cap 7 as well as two coil connecting pins 8 which are anchored in the coil former.

The coil former 1 has an axial through-opening 11 as well as a first flange 12 and a second flange 13, between which a winding 10 is fitted. At the end, an attachment 14 for armature mounting is integrally formed on the coil flange 12, and merges into a base plate 15. Furthermore, limiting pins 16 for the armature are integrally formed on the attachment 14 and, furthermore, plug-in slots 17 are formed in this attachment, through which plug-in slots 17 the connecting elements 51 and 61, respectively, of the contact springs 5 and 6 can be passed through the base plate 15, at right angles, to the exterior. Furthermore, a stop tab 18 for the stationary contact spring 5 is integrally formed on the second coil flange 13.

The T-shaped core 2 has a longitudinal limb 21 which is introduced into the through-opening 11 in the coil former, as well as two transverse limbs 22, to each of whose ends side arms 23 are fitted, parallel to the longitudinal limb 21. The U-shaped armature 3 comprises two longitudinal arms 31 and a transverse web 32, the latter of which is mounted on the free end section 24 of the core 2 and is then located in a recess between the first coil flange 12 and the base plate 15. The two securing pins 16 of the base attachment 14, which engage in corresponding recesses 33 in the armature, ensure that the armature is secured against lateral movements, without this impeding its switching movement. The free ends of the longitudinal arms 31 are broadened to form hook-shaped pole ends 34 which engage around the second coil flange 13 and form two parallel operating air gaps with the transverse limbs 22 as well as their side arms 23 of the core.

Figure 3:
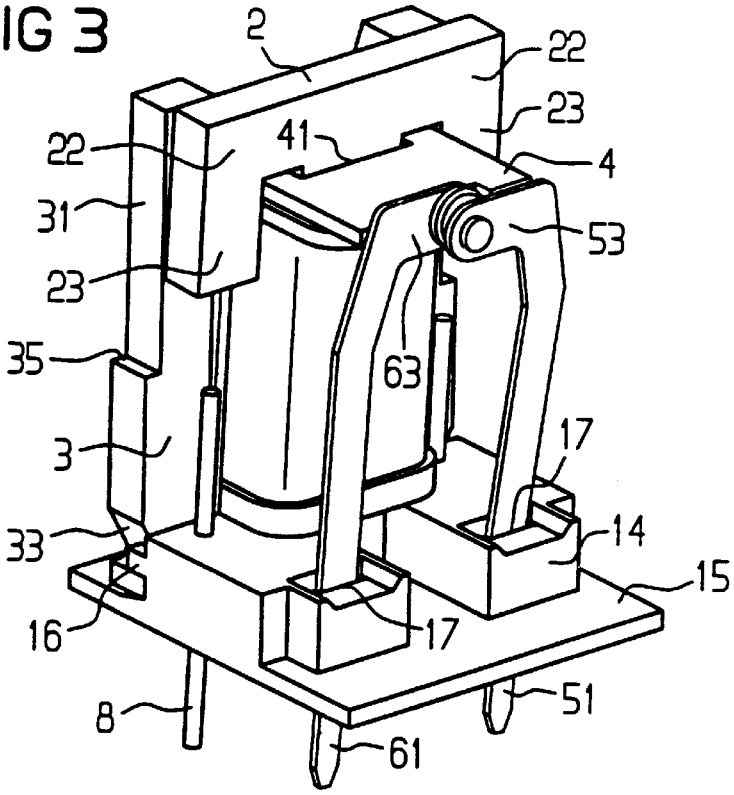

The stationary contact spring 5 and moving contact spring 6 are anchored in the plug-in slots 17 in the base attachment 14 by means of their connecting elements 51 and 61, respectively, which are integrally formed or are attached in a known manner. In the present example, the two contact springs 5 and 6 are of identical design and are provided with end sections 53 and 63 (FIG. 3) which have respective contacts 52 and 62. The mutual overlap in order to make contact is provided by an L-shaped bend at their moving, contact-making ends.

Figure 2:
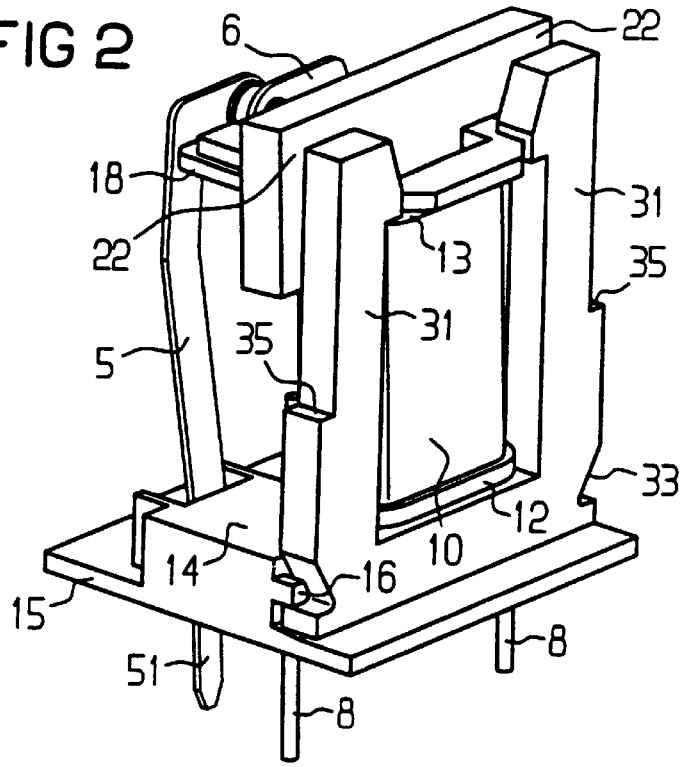
FIGS. 2 and 3 show—in two perspective views—a completely assembled relay according to FIG. 1—without a cap—and FIG. 4 shows a section through the coil axis of the completely assembled relay from FIG. 1.

The contact springs 5 and 6 are just cut from a flat metal sheet without bending, and are inserted into the coil former. The mutual offset between their contact-making ends results simply from the geometry of the coil former and of the slide 4. This slide is located between the coil flange 13 and the transverse limbs 22 of the core. It has a recess aperture or opening 41 through which the core longitudinal limb 21 is passed. Once the parts have been joined together, the end section 53 (which is bent in an L-shape) of the stationary contact spring 5 (see FIGS. 2 and 3) rests on the stop tab 18 on the coil former 1, and is thus given its rest pre-stressing. On the other side, the end section 63 (which is bent in an L-shape) of the moving contact spring 6 rests on the slide 4. When the slide 4 is operated by the armature, the end section 63 is moved in the direction of the end section 53 of the stationary contact spring 5, and lifts the latter off its stop on the tab 18. This is how the contact force is produced.

Figure 4:
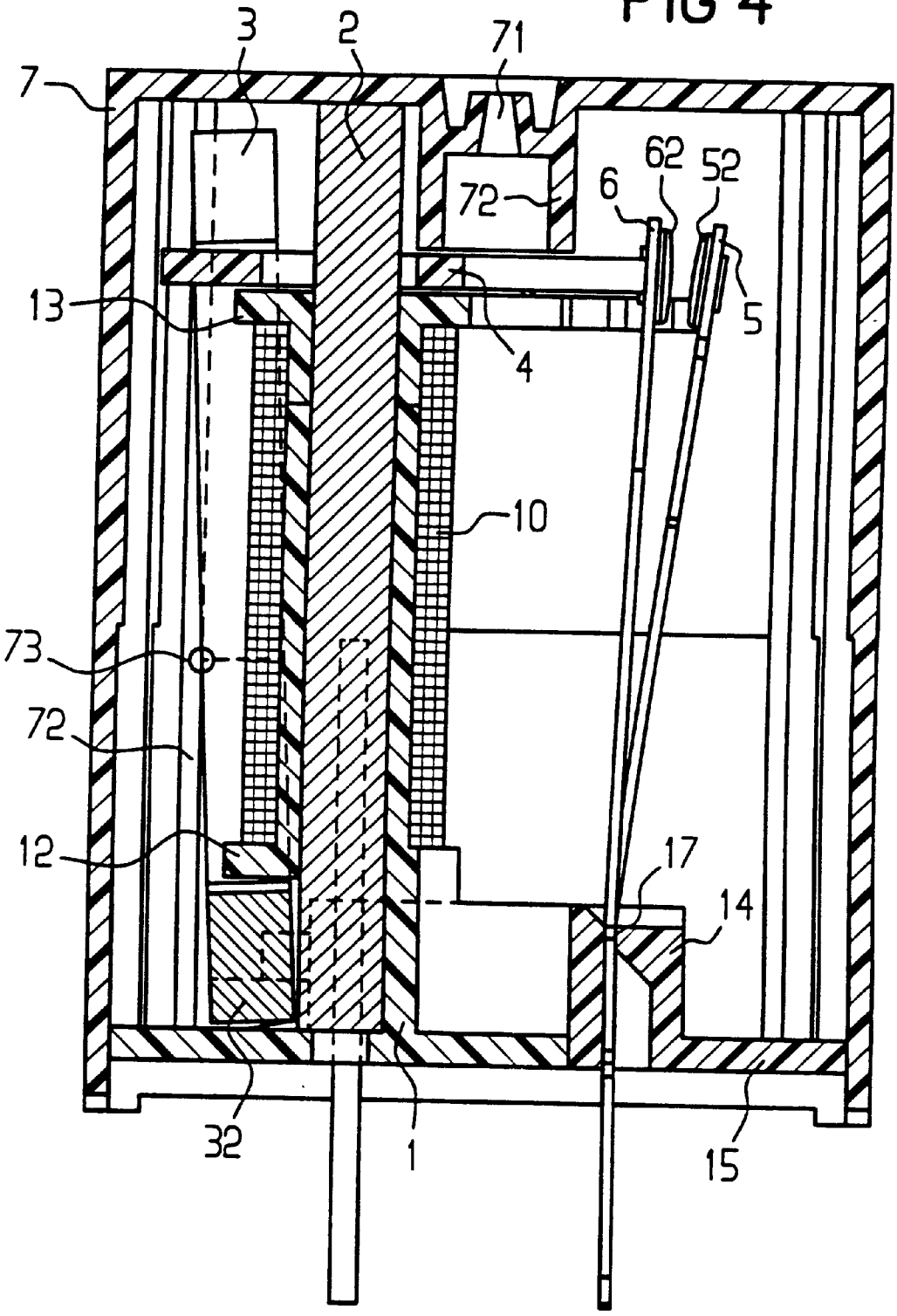

After assembly of the described individual parts, the cap 7 is fitted over the relay. It forms a closed housing with the base plate 15. As can be seen from FIG. 4, the cap 7 has in the region of its top a ventilation hole 71 which opens into an inwardly projecting attachment 72. The latter attachment forms an additional guide for the slide 4. As can also be seen from FIG. 4, the armature 3 is pre-stressed via the slide 4 into its rest position by means of the resetting force of the operating contact spring 6. In this case, lateral shoulders 35 on the armature abut against ribs 72 on the cap, forming a fulcrum 73 for the armature. The mounted end or the transverse web 32 of the armature is forced by the lever effect, via this fulcrum 73, into the bearing and against the end section 24 of the core. This results in reproducible flux transfer conditions in the armature mounting, and correspondingly low pull-in excitation.

We claim:

1. Electromagnetic relay having a coil winding which is arranged on a coil former between first and second coil flanges, a T-shaped core having a longitudinal limb and two transverse limbs, the longitudinal limb extending axially through the coil former, a U-shaped armature having two longitudinal arms, which run on both sides of the coil, and a transverse web at a first end section of the armature being mounted in the region of the first coil flange on an end section of the core, and a second end section forming an operating air gap with the core in the region of the second coil flange, and a contact arrangement having at least one stationary contact element and at least one moving contact spring, the moving contact spring being operable by the armature via an operating device which can be moved transversely with respect to the coil axis, the improvement comprising the armature being mounted at the transverse web on the free end section of the longitudinal limb of the core, and the free ends of the armature longitudinal arms form two parallel operating air gaps with free ends of the core transverse limbs.

2. Relay according to claim 1, wherein the core transverse limbs each have projections which run in the direction of the armature longitudinal arms and enlarge the effective pole areas with the armature.

3. A relay according to claim 1, wherein the first coil flange has an attachment and wherein the attachment and the armature have projections and recesses which engage in one another in order to secure the mounted first end section of the armature in at least one direction.

4. A relay according to claim 1, wherein the contact spring which is operated by the armature is arranged approximately parallel to the coil axis on the side opposite the armature, and wherein a slide, which is used to transmit the armature movement to the contact spring, is guided between the transverse limbs of the core and the adjacent coil flange, so that the slide moves at right angles to the coil axis.

5. A relay according to claim 1, wherein the first coil flange forms a projection in the form of a base which defines a base plane and the coil axis extends at a right angle to the base plane.

6. A relay according to claim 5, wherein a housing cap forms a closed housing together with the base, the armature being secured in its mounting between the base and the housing cap.

7. A relay according to claim 5, wherein at least one moving contact spring and at least one stationary contact element are anchored in the base to extend at right angles to the base plane, and associated connecting pins are passed at right angles through the base plane to the exterior.

8. A relay according to claim 7, wherein the second coil flange forms a stop for the rest position for one of the stationary contact element and the moving contact spring.

9. A relay according to claim 1, wherein the free ends of the armature longitudinal arms are pre-stressed away from the core into a rest position by means of a resetting spring force, and the longitudinal arms of the armature each form in their center region a fulcrum with respect to a housing part by which the resetting spring force forces the transverse web of the armature into its bearing on the core.

10. A relay according to claim 9, wherein the fulcrum is formed by lateral shoulders on the armature longitudinal arms, which shoulders rest on an internal edge of a housing cap.

* * * * *